US006260202B1

(12) United States Patent
Villalobos et al.

(10) Patent No.: US 6,260,202 B1
(45) Date of Patent: Jul. 17, 2001

(54) VEST FOR WORK IN RADIOACTIVE ENVIRONMENTS

(75) Inventors: Librado P. Villalobos, San Diego; Raul V. Contreras, Oceanside; Anthony M. Granieri, San Clemente, all of CA (US)

(73) Assignee: Southern California Edison, Rosemead, CA (US)

( * ) Notice: Subject to any disclaimer, the term of this patent is extended or adjusted under 35 U.S.C. 154(b) by 0 days.

(21) Appl. No.: 09/239,557

(22) Filed: Jan. 29, 1999

(51) Int. Cl.[7] ..... A41D 1/04

(52) U.S. Cl. ..... 2/102; 2/247; 2/901; 224/637; 224/647; 224/648; 224/930; 250/394

(58) Field of Search ..... 2/457, 102, 247, 2/901, 94, 125; 379/430; 119/770; 54/1, 79.1; 224/646, 647, 648, 649, 637, 652, 903, 215; 250/336.1, 374, 394

(56) References Cited

U.S. PATENT DOCUMENTS

| | | | | |
|---|---|---|---|---|
| 1,290,827 | * | 1/1919 | Yergason . | |
| 3,409,007 | * | 11/1968 | Fuller | 128/2.06 |
| 4,608,716 | * | 9/1986 | Brumfield | 2/2.5 |
| 4,825,471 | * | 5/1989 | Jennings | 2/94 |
| 4,876,724 | * | 10/1989 | Suzuki | 2/94 |
| 5,024,360 | * | 6/1991 | Rodriguez | 224/215 |
| 5,054,127 | * | 10/1991 | Zevchak | 2/247 |
| 5,211,321 | * | 5/1993 | Rodriguez | 224/215 |
| 5,718,000 | * | 2/1998 | Ost et al. | 2/69 |
| 5,768,706 | * | 6/1998 | Griffith et al. | 2/102 |
| 6,035,450 | * | 3/2000 | Monsen, III et al. | 2/422 |

* cited by examiner

*Primary Examiner*—Michael A. Neas
(74) *Attorney, Agent, or Firm*—Sheldon & Mak; Denton L. Anderson

(57) ABSTRACT

A vest useful for work in radioactive environments is provided. The vest comprises (a) a garment for substantially traversing the upper body of a user while being supported by the shoulders of the user, the garment having a front portion, a rear portion, opposed side portions and opposed shoulder portions, (b) a pocket disposed on the portion of the garment for accepting and retaining a communications data transmitter with dosimeter, and (c) a pair of adjustable sleeve elements attached to the garment, each sleeve element having a sleeve pocket for accepting and retaining a remotely transmitting dosimeter probe at a position above the elbow of the user. The invention has been found to provide a convenient method for firmly retaining at least five personal teledosimeter detectors on the upper torso of a worker having to work within a radiation hazardous environment. The invention has also been found to provide a convenient method of carrying teledosimetry and audio communications receiver/transmitter equipment without interfering with the arm and body movements of the worker.

18 Claims, 2 Drawing Sheets

VEST FOR WORK IN RADIOACTIVE ENVIRONMENTS

FIELD OF THE INVENTION

This invention relates generally to vests and, specifically, to vests used in hazardous environments.

BACKGROUND OF THE INVENTION

Since the earliest days of the Industrial Revolution, industry has struggled to safely conduct plant maintenance and other necessary work within hazardous environments. Prior to the second half of this century, most such hazardous environments involved hazardous chemical agents. Since 1950, such hazardous environments may also involve radioactive agents. Industry is continuously working towards improving equipment and techniques which will make working within such hazardous environments safer.

The nuclear power industry has been especially active in this regard. The problem faced by the nuclear power industry is how to safely conduct maintenance and other necessary work within the large confining structures wherein potential sources of radioactivity are typically housed. Work within such confining structures requires extensive efforts to minimize dangers to workers from radioactive exposure. Such efforts have included the employment of personal dosimeters to monitor the individual radiation exposure of each worker. Also, such efforts have increasingly included the use of audio communication tools, such as walky-talkies, hardwired intercoms and cellular phones. Use of such audio communications allows supervisory personnel located outside the confining structure or area to assist in a more efficient—and, therefore, a more swift—completion of the work within the hazardous area.

Traditionally, personal dosimeter devices have been attached to the protective clothing of the worker by tape or other ad hoc means. Under working conditions, however, the dosimeters tend to become dislodged from the clothing of the worker. Accordingly, there is a need for worker protective clothing which can simply and efficiently retain personal dosimeters.

The use of audio communications equipment has also experienced problems. The use of audio communications equipment requires the user to hand-carry audio transmitting equipment around with him. This is awkward and inefficient. Accordingly, there is a need for worker protective clothing which can simply and efficiently retain audio transmitting equipment.

SUMMARY

The invention satisfies these needs. The invention is a combination comprising: (a) a garment for substantially traversing the upper body of a user while being supported by the shoulders of the user, the garment having a front portion, a rear portion, opposed side portions and opposed shoulder portions, (b) a receiver/transmitter pocket disposed on the portion of the garment for accepting and retaining a communications data transmitter, and (c) a pair of adjustable sleeve elements ached to the garment, each sleeve element having a sleeve pocket for accepting and retain a remotely transmitting dosimeter and a passive dosimeter at a position above the elbow of the user.

Typically, the garment is made from a flexible material, such as cotton. Preferably, the garment is adjustable, both in length and in girth, by openings having hook and loop fasteners.

The invention is ideal when used in combination with a unique head gear as described in U.S. patent application Ser. No. 09/239,228, entitled "Head Gear for Work in Radioactive Environments," filed concurrently herewith. The invention is also ideal when used in combination with a unique module pack as described in U.S. patent application Ser. No. 09/240,917, entitled "Module Pack for Coordination of Work Within Hazardous Environments," filed concurrently herewith. Finally, the invention is ideal with used in combination with a unique system for protecting workers within hazardous environments as described in U.S. patent application Ser. No. 09/239,567, entitled "Protective System for Work in Radioactive Environments," also filed concurrently herewith. The entirety of each of these three patent applications is incorporated herein by this reference.

DRAWINGS

These features, aspects and advantages of the present invention will become better understood with regard to the following description, appended claims and accompanying figures where:

DETAILED DESCRIPTION

Figure 1:
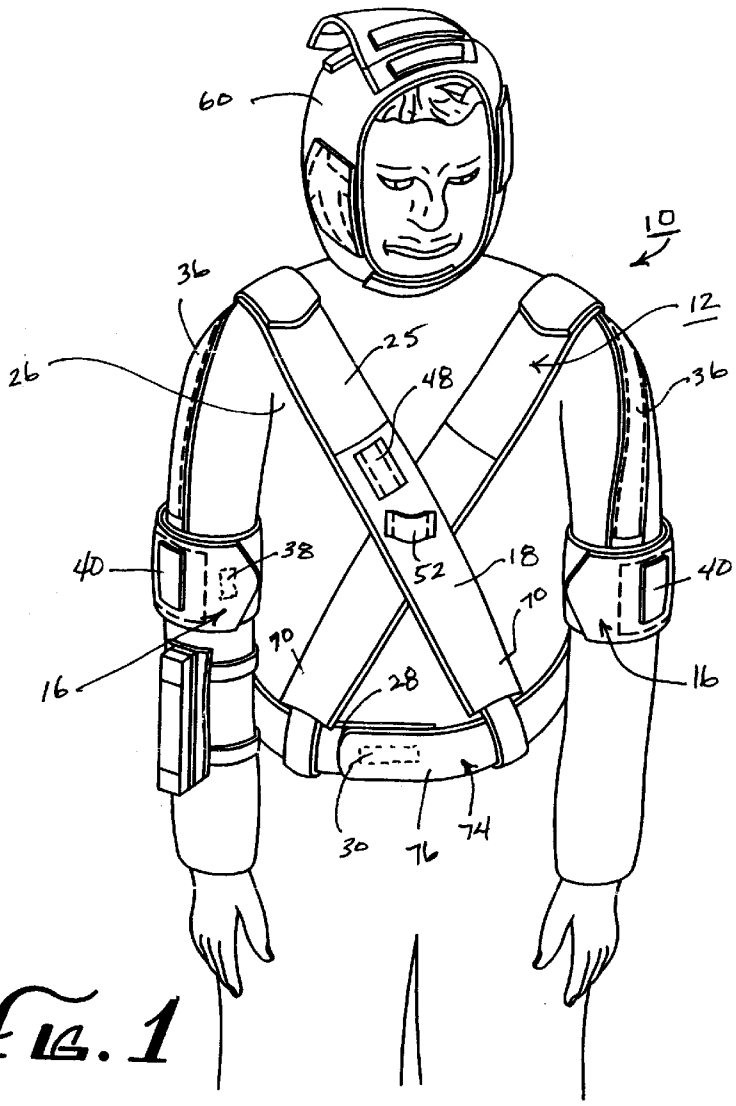
FIG. 1 is a perspective view of the front and right side of a combination having features of the invention.
Figure 2:
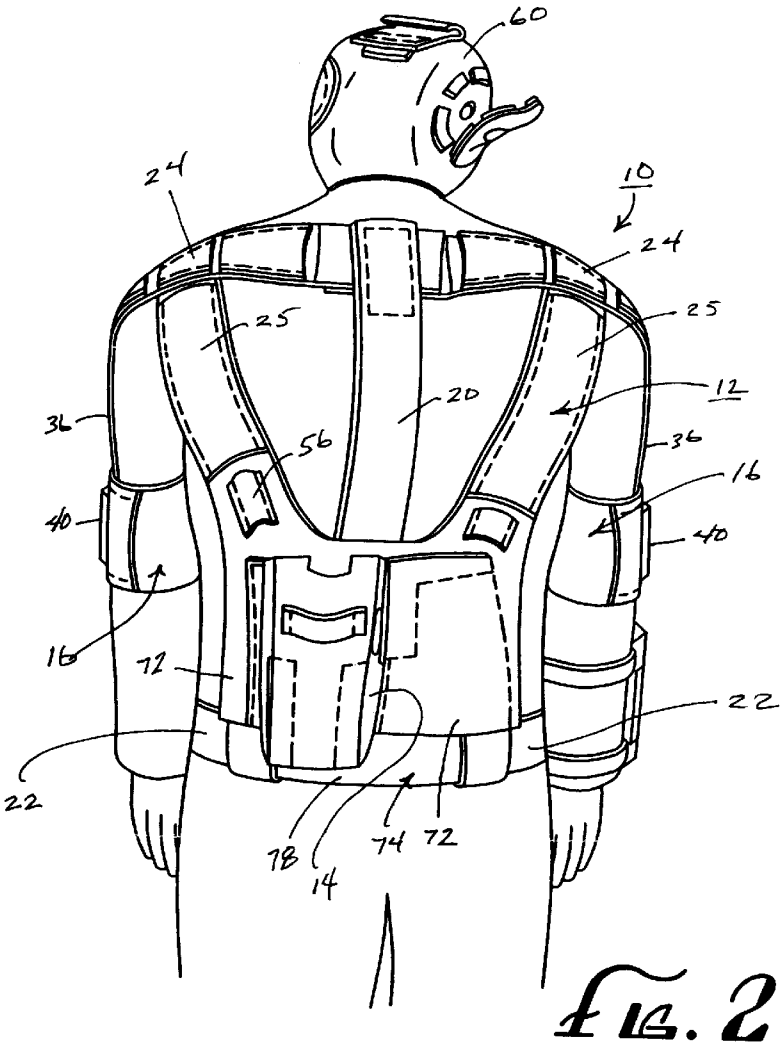
FIG. 2 is a perspective view of the rear and right sides of the combination illustrated in FIG. 1.
Figure 4:
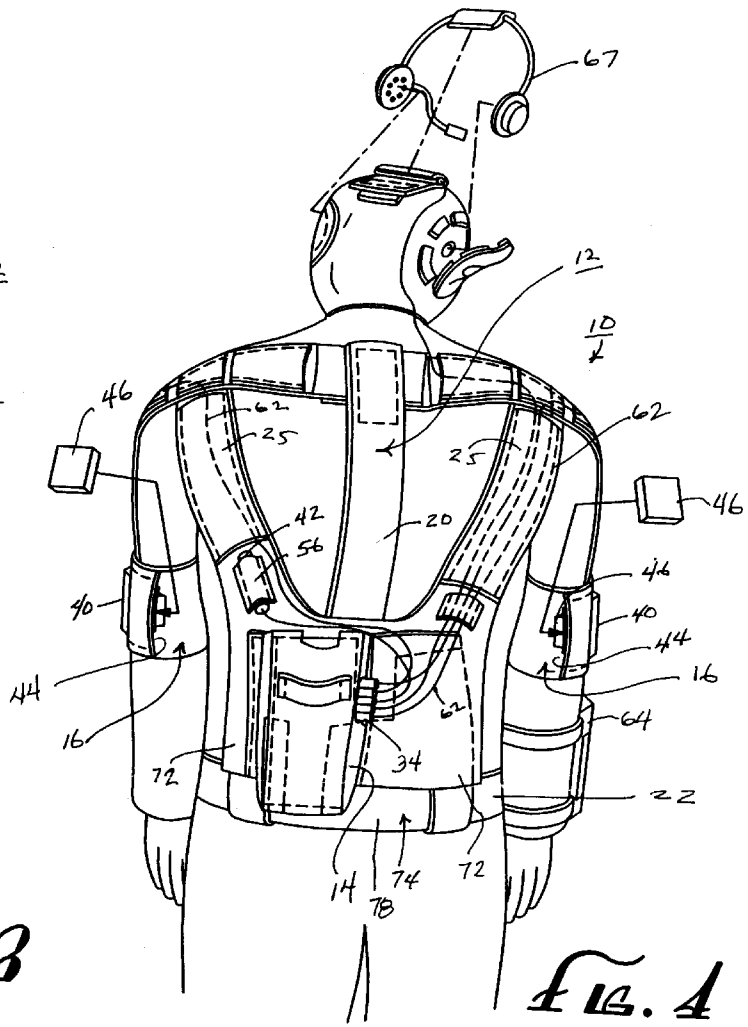
FIG. 4 is a perspective view of the rear and right sides of the combination illustrated in FIG. 2, showing the installation of various analytical and communications devices.
Figure 3:
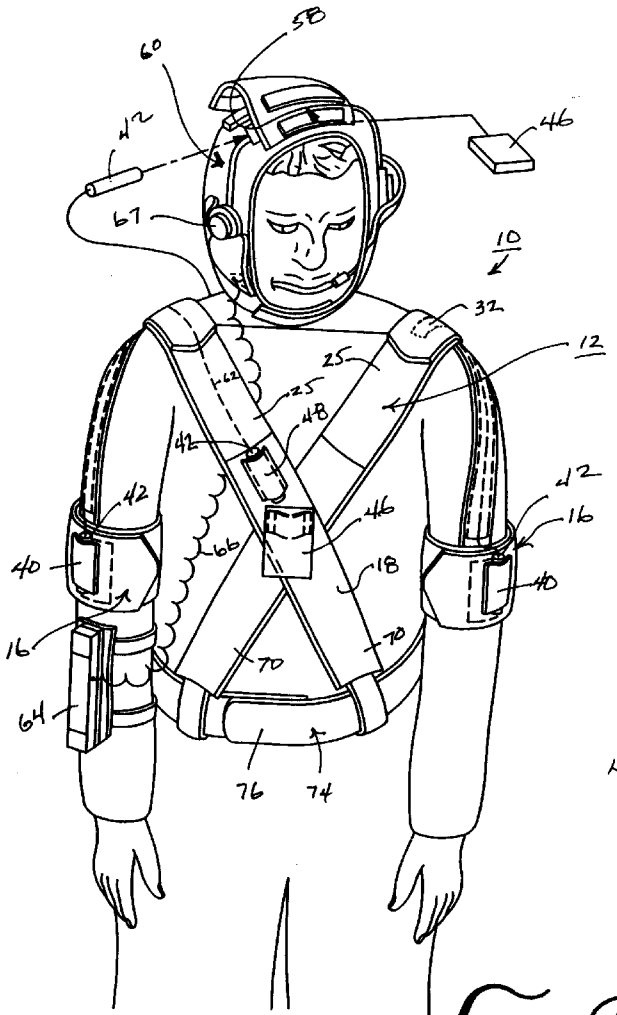
FIG. 3 is a perspective view of the front and right side of the combination illustrated in FIG. 1, shown carrying various analytical and communications devices.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a combination 10 comprising a garment 12, a receiver/transmitter pocket 14 and a pair of adjustable sleeve elements 16.

The garment 12 substantially traverses the upper body of the user while being supported by the shoulders of the user. The garment 12 has a front portion 18, a rear portion 20, opposed side portions 22 and opposed shoulder portions 24. The garment 12 is typically made from a flexible material, such as a flexible cloth or plastic material. Cotton, cotton-polyester or nylon can be used as materials for the garment, with cotton being preferable because it is easily cleaned and is readily incinerable when disposed as radioactive waste.

In a typical embodiment, such as the one illustrated in the drawings, the garment 12 has opposed arm holes 26 and a reversible opening 28 to allow the user to put on the garment 12 and take off the garment 12 without pulling the garment 12 over the head of the user. For convenience, the reversible opening 28 is preferably disposed in the front portion 18 of the garment 12. The reversible opening 28 allows the garment 12 to be reversibly opened and closed. Preferably, the reversible opening 28 is also adjustable to allow for users of different girths. The reversible opening 28 typically comprises fasteners 30, such as hook and loop fasteners (e.g., Velcro® fasteners), snap fasteners, button fasteners, hook and eye fasteners, slot and tab fasteners or zipper fasteners). Hook and loop fasteners are generally preferred because of their ease of manufacture and use and because of their inherent "adjustability."

In the embodiment illustrated in the drawings, the shoulder portions 24 comprise shoulder straps 25. Each shoulder strap 25 is adjustable in length, preferably using hook and loop fasteners 32.

Each shoulder strap 25 has a front end 70 and a rear end 72. Each shoulder strap 25 is attached to a waist strap 74 having a front side 76 and a rear side 78. The front end 70 of each shoulder strap 25 is attached to the front side 76 of the waist strap 74 and the rear end 72 of each shoulder strap 25 is attached to the rear side 78 of the waist strap 74.

The receiver/transmitter pocket 14 is sized and dimensioned to receive a receiver/transmitter 34 for receiving dosimetry radiation data and transmitting that data via electromagnetic waves to a location remote from the user. The receiver/transmitter 34 also typically comprises an audio receiver/transmitter moiety capable of receiving and transmitting audio communication signals. The receiver/transmitter 34 also typically comprises an internally-disposed electronic teledosimetry probe.

In situations where the user of the invention 10 is also required to carry body-mounted teledosimeter probes on his or her lower person, the receiver/transmitter 34 can be used to receive radiation dosimetry data from such teledosimeter probes and transmit that data to a remote receiving station.

Since the transmitter/receiver 34 is typically rectangular, it is typical that the receiver/transmitter pocket 14 be rectangular in shape, as well. Where the receiver/transmitter pocket 14 is rectangular in shape, the receiver/transmitter pocket 14 typically has three closed sides and one open side. However, "tunnel" receiver/transmitter pockets 14 having a pair of opposed open sides are also useable in the invention 10. In a typical embodiment, the receiver/transmitter pocket 14 encompasses a volume between about 25 cubic inches and about 75 cubic inches, more typically between about 40 cubic inches and about 60 cubic inches.

As shown in the embodiment illustrated in the drawings, the sleeve elements 16 can be arm bands 16 which are attached to the shoulder portions 24 of the garment 12 by arm band connection elements 36. Each arm band connection element 36 is preferably a narrow arm band strap as illustrated in the drawings. Each arm band 16 is preferably adjustable in circumference so that each arm band 16 can be positioned and firmly retained at a specific location along one of the user's arms. Both sleeve elements 16 are most preferably adjustable so that the sleeve elements 16 can be worn above the 16 elbows of the user. In the embodiment illustrated in the drawings, each arm band 16 is adjustable by hook and loop fasteners 38. Other fasteners, such as snaps, buttons, hook and eye fasteners, slot and tab fasteners, and zipper fasteners can be used.

Each of the sleeve elements 16 has a sleeve pocket 40 for accepting and retaining a remotely transmitting dosimeter probe 42. In the embodiment illustrated in the drawings, each arm band 16 further comprises an arm band pocket 44 for receiving a passive dosimeter 46.

The embodiment illustrated in the drawings further comprises (i) a front pocket 48 for retaining a personal teledosimeter probe 42, (ii) a passive dosimeter attachment element 52 for retaining a front-mounted passive dosimeter 46, and (iii) a rear pocket 56 for storing a head-mounted personal teledosimeter probe 42 when the head-mounted teledosimeter probe 42 is not being used.

The invention has been found to provide a convenient method for firmly retaining at least five personal teledosimeters detectors 42 on the upper torso of a worker having to work within a radiation hazardous environment, and three passive dosimeters 46. The invention has also been found to provide a convenient method of carrying teledosimetry and audio communications receiver/transmitter equipment 34 without interfering with the arm or body movements of the worker.

In operation, the user of the invention 10 places the garment 12 on his or her person by opening the reversible opening 28 and placing each of his or her arms through an arm hole 26. After the garment 12 is placed on the worker, the reversible opening 28 is closed by reattachment of the hook and loop fasteners 30. The reversible opening 28 is reclosed such that the garment is properly adjusted to the girth of the worker.

After the worker puts the garment 12 on, he or she adjusts the shoulder straps 25 using the hook and loop fasteners 32 so that the garment 12 is properly supported by the shoulder straps 25. The worker then adjusts each arm band 16 to a proper position on each of the worker's arms and tightens each arm band 16 using the hook and loop fasteners 38 so that the arm bands 16 are firmly retained in their respective proper locations.

The worker then places personal teledosimeters 42 in each of the arm band pockets 40, in the front pocket 48 and in a pocket 58 located in head gear 60 worn by the worker. Connection wires 62 running from each of these four teledosimeter probes 42 are conveniently retained within one or both of the shoulder straps 16, so as to not inhibit the worker in his or her duties. Each of the four dosimeter probe wires 62 is connected to the receiver/transmitter 34 which the worker places in the receiver/transmitter pocket 14 located in the rear portion 20 of the garment 12.

Where the receiver/transmitter 34 includes an audio receiver/transmitter moiety, the worker can further attach a wrist-mounted radio or cellular phone 64 which is wired to a head set 67 via phone wire 66.

The worker is thereafter ready to enter a radiation hazardous environment. While he or she is within the environment, the four teledosimeter detectors 42 can transmit personal radiation dosage data to health physics technicians who monitor such data to be sure the radiation exposure to the worker is minimized. The worker can also communicate with fellow workers within the hazardous environment and/or with supervisory personnel outside the hazardous environment via the wrist-mounted radio or cellular phone 64. As can be appreciated, each of the teledosimeters 42 and the wrist-mounted radio or cellular phone 64 is conveniently retained on the person of the worker such that it does not interfere with his or her duties. Moreover, each of the transmitting wires 62 and 66 between each of the teledosimeter probes 42 and the wrist-mounted radio or cellular phone 64 and the receiver/transmitter 14 is conveniently retained on the person of the worker such that it does not interfere with his or her duties.

Having thus described the invention, it should be apparent that numerous structural modifications and adaptations may be resorted to without departing from the scope and fair meaning of the instant invention as set forth hereinabove and as described hereinbelow by the claims. In this regard, any element in a claim that does not explicitly state "means" for performing a specified function, or "step" for performing a specified function should not be interpreted as a "means" or a "step" clause as specified in 35 U.S.C. § 112.

What is claimed is:

1. A combination comprising:

(a) a garment for substantially traversing the upper body of a user while being supported by the shoulders of the user, the garment having a front portion, a rear portion, opposed side portions and opposed shoulder portions, the garment comprising a waist strap and a pair of shoulder straps, the waist strap being adapted to circumscribe the waist of the user and having a front side and a rear side, each shoulder strap having a front end and a rear end, the front end of each shoulder strap being attached to the front side of the waist strap and the rear end of each shoulder strap being attached to the rear side of the waist strap;

(b) a dosimeter data receiver/transmitter disposed within a receiver/transmitter pocket located on the rear portion of the garment for transmitting and receiving dosimetry data;

(c) a pair of adjustable sleeve elements attached to the garment, each sleeve element being an arm band having a remotely transmitting dosimeter probe located within a sleeve pocket at a position above the elbow of the user;

(d) an arm band connection strap for connecting each shoulder portion of the garment to one of the sleeve elements; and (e) wires operatively connecting the dosimeter data receiver/transmitter to each of the remotely transmitting dosimeter probes.

2. The combination of claim 1 wherein the garment is made from a flexible material.

3. The combination of claim 1 wherein the garment is made from a plastic material.

4. The combination of claim 1 wherein the garment is substantially cotton.

5. The combination of claim 1 wherein the garment comprises opposed arm holes and a reversible opening to allow the user to put on the garment and take off the garment without pulling the garment over the head of the user.

6. The combination of claim 5 wherein the reversible opening is disposed in the front portion of the garment.

7. The combination of claim 5 wherein the reversible opening comprises fasteners selected from the group of fasteners consisting of hook and loop, snap, button, hook and eye, slot and tab, and zipper fasteners.

8. The combination of claim 5 wherein the reversible opening comprises hook and loop fasteners.

9. The combination of claim 1 wherein each shoulder strap is adjustable in length.

10. The combination of claim 9 wherein each shoulder strap comprises hook and loop fasteners to allow each shoulder strap to be adjusted in length.

11. The combination of claim 1 wherein the receiver/transmitter pocket defines a volume between about 25 cubic inches and about 75 cubic inches.

12. The combination of claim 1 wherein the receiver/transmitter pocket defines a volume between about 40 cubic inches and about 60 cubic inches.

13. The combination of claim 1 wherein the receiver/transmitter pocket is substantially rectangular in shape.

14. The combination of claim 1 wherein the sleeve elements are arm bands which are each adjustable in circumference.

15. The combination of claim 14 wherein the arm bands comprise hook and loop fasteners to allow the arm bands to be adjustable in circumference.

16. The combination of claim 1 further comprising a remotely transmitting dosimeter probe disposed within a front pocket located on the front portion of the garment.

17. The combination of claim 1 further comprising a remotely transmitting dosimeter probe disposed within a rear pocket located on the rear portion of the garment.

18. The combination of claim 1 wherein each sleeve element further comprises a passive dosimeter located within a passive dosimeter pocket.

* * * * *